United States Patent [19]

Billing

[11] 4,347,963

[45] Sep. 7, 1982

[54] HYDRAULIC NAILING MACHINE

[76] Inventor: Lars J. T. Billing, Värmlandsgaten 2, S-25252 Helsingborg, Sweden

[21] Appl. No.: 154,413

[22] PCT Filed: Jan. 16, 1979

[86] PCT No.: PCT/SE79/00010

§ 371 Date: Sep. 19, 1979

§ 102(e) Date: Sep. 6, 1979

[87] PCT Pub. No.: WO79/00531

PCT Pub. Date: Aug. 9, 1979

[30] Foreign Application Priority Data

Jan. 19, 1978 [SE] Sweden ..... 7800644

[51] Int. Cl.[3] ..... B25C 1/04

[52] U.S. Cl. ..... 227/8; 173/119; 173/DIG. 1; 227/130

[58] Field of Search ..... 227/8, 130; 91/341 R, 91/337; 173/119, 124, 127, 114, 131, DIG. 1; 92/30, 130 R

[56] References Cited

U.S. PATENT DOCUMENTS 2,559,478 7/1951 Stone ..... 91/337 X
3,888,404 6/1975 Ramspeck et al. ..... 227/8
4,078,409 3/1978 Brown et al. ..... 227/130 X

FOREIGN PATENT DOCUMENTS 518777 3/1972 Switzerland ..... 227/130
534567 3/1973 Switzerland ..... 227/130

*Primary Examiner*—Paul A. Bell
*Attorney, Agent, or Firm*—Blanchard, Flynn, Thiel, Boutell & Tanis

[57] ABSTRACT

A hydraulic nailing pistol with force or energy-accumulators for reciprocally driving a nail driver (5) formed as a piston with associated piston rod (5). The outer end of the rod is intended for applying to the nail head of the nail to be driven. The piston is arranged in a hydraulic cylinder (26) and the end of the cylinder facing away from the nailing end of the rod is connected, by the intermediary of an openable and closeable valve (3), to a first hydraulic operating cylinder (A) provided with a piston (4), actuable by a force or energy-accumulating component, e.g. a spring (6). The other end of the hydraulic cylinder (26) is connected to a second hydraulic operating cylinder (B), provided with a piston (11), also actuable by a force or energy-accumulating component, e.g. a spring (12). The first operating cylinder (A) with its cylinder (4) is adapted for driving the driver forwards, and the second operating cylinder (B) with its piston (11) is adapted for providing the return movement of the driver (5).

By making the pistol in the fashion described, all functions are built into the movable portion of the pistol with simple means, while retaining small dimensions and comfortably low weight, at the same time as the tool develops greater power during nailing.

8 Claims, 2 Drawing Figures

HYDRAULIC NAILING MACHINE

FIELD OF THE INVENTION

The invention relates to a hydraulic nailing pistol, the reciprocating movement of the nail driver being provided by hydraulic operating cylinders, which are equipped with force or energy accumulators. In the inventive device, all functions are built into the movable part of the pistol with simple means while retaining small dimensions and comfortably low weight, the tool developing great power during nailing.

BRIEF DESCRIPTION OF THE DRAWINGS

An embodiment of a nailing pistol in accordance with the invention is described below in conjunction with the attached drawing, in which.

DETAILED DESCRIPTION

Figure 1:
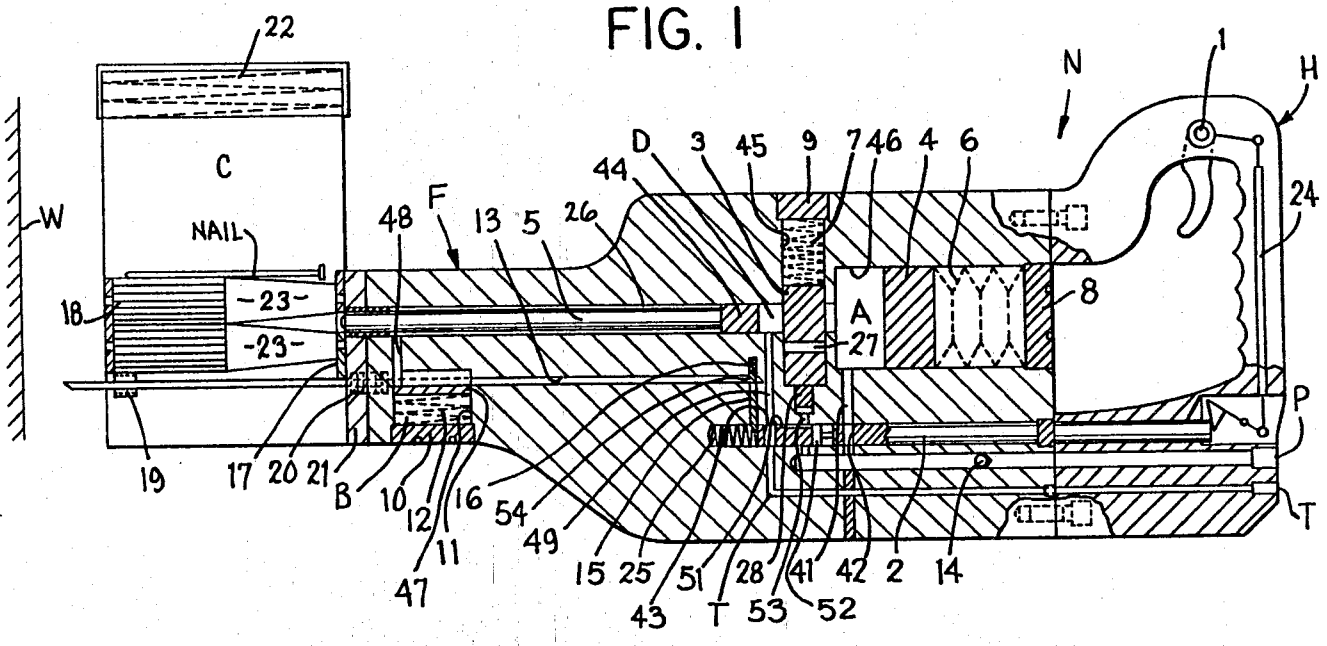
FIG. 1 shows the pistol seen from one side, and partly in section.

A nailing pistol N includes a frame F having a manually engageable handle portion H at one end thereof and a nail magazine C at the other end thereof. The nail magazine C is adapted to house plural nails therein. The nail magazine C has a pair of magnetic magazine rollers 23 capable of magnetically holding a nail as they are rotated to bring a nail into alignment with the nail driver 5.

A guide cylinder 26 is provided in the frame F and reciprocally houses a nail driving piston rod 5 therein. The piston rod has a piston head 44 at one end thereof. The piston rod 5 is axially aligned with the not-illustrated outlet opening from the nail magazine C. The guide cylinder 26 communicates through a reservoir chamber D with a transversely extending chamber 45 in the frame F. A starting valve 3 is reciprocally mounted in the chamber 45 against the urging of a spring 7 butted against an abutment member 9. The starting valve 3 has a transversely extending opening 27 therein initially out of alignment with the reservoir chamber D.

A first energy accumulating chamber 46, hereinafter referred to as the chamber A, is provided in the frame F and reciprocally houses therein a piston 4. A spring 6 is provided between the piston 4 and an abutment member 8. The chamber A is connected to the chamber 45 and is preferably axially aligned with the reservoir chamber D. The opening 27 is initially out of alignment with the connection between the chamber A and the chamber D.

A second energy accumulating chamber 47, hereinafter referred to as the chamber B, is provided on the frame F and is located adjacent the nail magazine C. A piston 11 is reciprocally mounted in the chamber 47. A spring 12 is provided between the piston 11 and an abutment member 10. A passageway 48 is connected to and extends between the chamber B and the guide cylinder 26. Thus, as the piston 44 is moved axially along the length of the guide cylinder 26, hydraulic fluid between the periphery of the piston rod 5 and the internal surface of the guide cylinder 26 is urged through the passageway 48 into the chamber B to push the piston 11 toward the abutment member 10 against the urging of the spring 12. This operation will be explained in further detail below.

An inlet opening P is provided in the frame F. A check valve 14 is provided in the inlet P. An outlet opening T is also provided in the frame F adjacent the inlet opening. The inlet opening P is connected to a not-illustrated source of pressurized hydraulic fluid. A passageway 41 interconnects the inlet P to the chamber A through an opening 42 in an operating slide 2 in a first position thereof. A passageway 49 connects the chamber D to the outlet T through an opening 43 in the operating slide 2. When the opening 42 interconnects the inlet P to the passageway 41, the opening 43 also provides connection between the passageway 49 and the outlet T.

The operating slide 2 also has a further opening 52 therein. A passageway 53 communicates through a groove 51 in the periphery of the operating slide 2 with the opening 43. The opening 52 is initially nonaligned with the passageway 53 as shown in FIG. 1. The passageway 53 communicates with the chamber 45 through the passageway 53 and on a side of the starting valve 3 remote from the abutment member 9.

A safety spindle 13 extends lengthwise of the frame F and beyond the nail magazine C as illustrated in FIG. 1. A locking pin is operatively connected with the safety spindle 13 to hold the operating slide 2 in the initial position thereof illustrated in FIG. 1. The locking pin 15 has an inclined surface member 54 thereon engaging an end of the safety spindle 13 remote from the end adjacent the magazine C.

Figure 2:
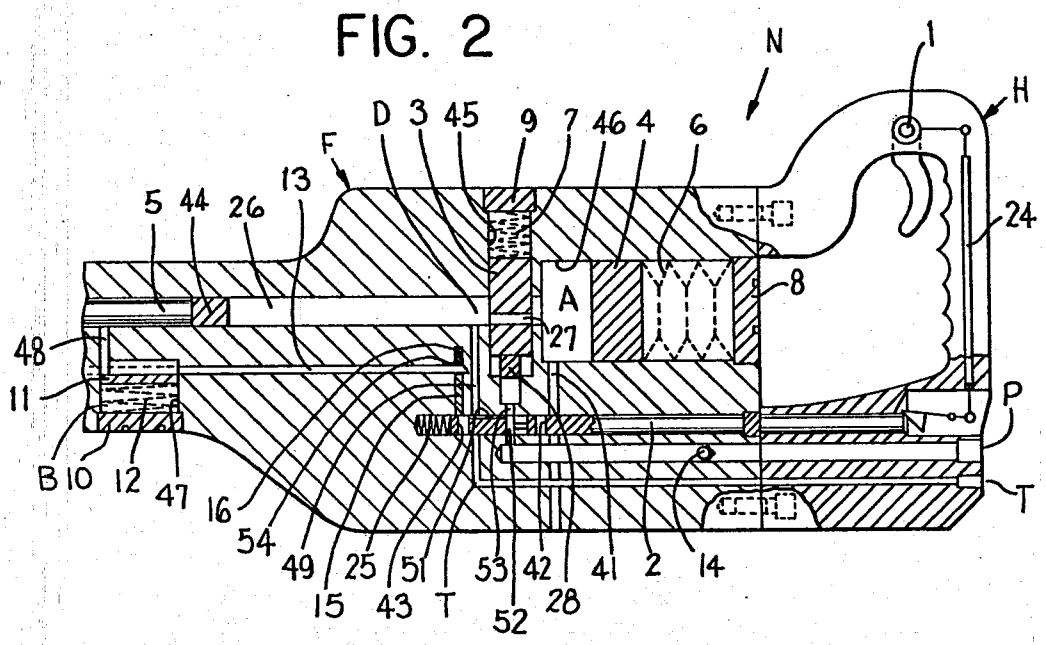
FIG. 2 is a fragment of the operating slide and the structure controlling its movement. It should be understood, however, that the invention is not to be limited to that which is apparent from the drawing as many modifications can prevail within the purview of the invention.

A manually engageable trigger 1 is provided with appropriate linkage 24 to effect an axial movement of the operating slide 2 axially against the urging of a spring 25 such as is illustrated in FIG. 2. In the shifted position of the operating slide 2, it is to be noted that the openings 42 and 43 become closed and the opening 52 becomes connected with the passageway 53 to shift the starting valve 3 upwardly to bring the opening 27 therethrough into alignment with the chambers A and D.

OPERATION

The pistol functions in the following way:

With the reciprocally operating slide 2 in the starting position shown in FIG. 1, and with pressurized oil connected to the inlet P, the cylinder A is filled with pressurized oil through the nonreturn valve 14 and passageway 41 to compress the energy-accumulating conical plate washers 6. The pistol can now be brought to bear against the workpiece, e.g. a wall W to effect a pressing of the safety spindle 13 thereagainst after a nail feed driving roller 19 turns the pour of magnetic rollers 23 into a position causing a nail to become axially aligned with a nail driver 5. An axial displacement of the safety spindle 13 causes the locking pin 15 to be displaced axially upwardly against the bias of spring 16 thereby releasing the operating slide 2, so that on actuation by the start mechanism 1, 24, the operating slide 2 can be moved axially (leftwardly to the FIG. 2 position) against the bias of the spring 25. The following measures thus occur substantially simultaneously: the inlet connection from the inlet P through the opening 42 in the operating slide 2 to the operating cylinder A and the outlet from the reservoir chamber D through the opening 43 in the operating slide 2 are closed. Pressurized oil is connected to the driving piston of the valve 3, which will be displaced axially upwardly against the bias of the spring 7, so that its port 27 connects the driving cylinder A to the hydraulic cylinder 26 of the nail driver 5. Nailing is now done by action of the driving piston 4 in coaction with the expanding energy-accumulating plate springs 6 situated in the driving cylinder A which causes oil to be forced from cylinder A into chamber D and against the nail driver driving piston 44.

The oil on the other side of the nail driver driving piston 44 is pressurized and causes a forcing back of the piston 11 in the return motion cylinder B, against the urging of the energy-accumulating spring 12. After the driver 5 has executed its nailing movement (see FIG. 2 position thereof), the operating slide 2 is unobstructed for returning to the starting position (FIG. 1) under the action of spring 25. The reservoir chamber D is thereafter connected to the outlet T via a port 43 in the slide 2, while the operating cylinder of the valve 3 is also connected to the outlet T via a groove 51 and port 43 in the operating slide 2 to close the port 27 connection between the operating cylinder A and the hydraulic cylinder 26, and the driving cylinder A is connected to the inlet P through the port 42 for renewed energy-accumulation by the plate springs 6. The nail driver can now be returned to the starting position with the aid of the pressure oil in the return cylinder B. When the nailing pistol is lifted after driving a nail home, the safety spindle 13 and the locking pin 15 return to the starting position.

The embodiments of the invention in which an exclusive property or privilege is claimed are defined as follows:

1. A hydraulic nailing pistol, comprising:

a frame means including an inlet opening and an outlet opening;

a magazine means secured to said frame means for housing plural nails;

guide cylinder means on said frame means;

a nail driving piston rod means reciprocally mounted in said guide cylinder means for effecting a driving of a nail from said magazine means;

hydraulically operated means for effecting a reciprocation of said nail driving piston rod means, said hydraulically operated means including:

(a) a first energy accumulator means adapted to be connected in fluid circuit with a pressurized fluid source through said inlet opening, said first energy accumulator means accummulating energy in response to a fluid connection to said inlet opening;

(b) passageway means connecting said first energy accumulator means in fluid circuit with said guide cylinder means on a side of said piston rod means remote from said magazine means;

(c) first valve means intermediate said first energy accumulator means and said guide cylinder means for opening and closing said passageway means;

(d) second energy accumulator means connected in fluid circuit with said guide cylinder means on a mutually adjacent side of said piston rod means as said magazine means, said second energy accumulator means accumulating energy in response to a movement of said piston rod means toward said magazine means;

(e) second valve means intermediate said first energy accumulator means and said inlet opening for opening and closing said fluid connection therebetween;

(f) first means defining a fluid connection between said guide cylinder means at an end thereof between said first valve means and said piston rod means and said outlet opening in said frame means;

(g) third valve means intermediate said guide cylinder means at the end thereof between said first valve means and said piston rod means, and said outlet opening for opening and closing said fluid connection therebetween, said third valve means also including means for effecting a closing of said first valve means in response to an opening of said third valve means;

(h) operating slide means operable between conditions effecting an opening and closing of said second and third valve means and a closing and opening, respectively, of said first valve means;

(i) second means for normally maintaining said operating slide means in a first condition to effect a closing of said first valve means and an opening of said second and third valve means so that said first energy accumulator means will accumulate energy; and (j) manually operative means for selectively changing the condition of said operating slide means to a second condition to effect a closing of said second and third valve means and an opening of said first valve means so that said piston rod means will be driven by the energy from said first energy accumulator means along the length of said guide cylinder means thereby effecting a driving of a nail from said magazine means and an accumulation of energy in said second energy accumulator means, the energy of said second energy accumulator means being used to effect a return of said piston rod means to a starting position thereof in response to said second means changing said condition of said operating slide means to said first condition thereof.

2. A hydraulic nailing pistol according to claim 1, wherein said operating slide means includes a shiftable safety spindle means for preventing actuation of said manual operative means, said shiftable safety spindle means being shiftable in response to an engagement thereof with a surface into which a nail is to be driven.

3. A hydraulic nailing pistol according to claim 1, wherein said second valve means is a first opening through said operating slide means, wherein said third valve means is a second opening through said operating slide means;

wherein said operating slide means is mounted on said frame means for axial movement between said first and second conditions for purposes of effecting an opening and closing of said second and third valve means.

4. A hydraulic nailing pistol according to claim 1, wherein said first energy accumulator means includes means defining a first chamber having a first piston reciprocally mounted therein and a first spring urging said first piston toward a side of said piston rod means adjacent said passageway means.

5. A hydraulic nailing pistol according to claim 1, wherein said second energy accumulator means includes means defining a second chamber having a second piston reciprocally mounted therein and a second spring urging said second piston toward a side of said piston rod means adjacent said magazine means.

6. A hydraulic nailing pistol according to claim 1, wherein said first valve means includes means defining a chamber having a piston-valve member with a transverse opening therein reciprocally mounted in said chamber, said transverse opening being thereby movable into and out of alignment with said passageway.

7. A hydraulic nailing pistol according to claim 6, wherein said chamber is connected to said inlet opening through an opened fourth valve means to effect a movement of said piston-valve member in said chamber; and wherein a spring is provided in said chamber for returning said piston-valve member to an initial position thereof upon a closing of said fourth valve means.

8. A hydraulic nailing pistol according to claim 7, wherein said operating slide means includes a groove therein for connecting said chamber to said outlet when said third valve means is opened.

* * * * *